United States Patent [19]

Bouix

[11] 3,942,465

[45] Mar. 9, 1976

[54] VEHICLE ADAPTED TO BE ADVANCED IN A FLUID

[76] Inventor: Maurice G. Bouix, 7, rue Sebastien Mercier, 75015, Paris, France

[22] Filed: May 21, 1975

[21] Appl. No.: 579,721

[30] Foreign Application Priority Data

May 28, 1974 France ..... 74.18333

[52] U.S. Cl. ..... 115/28 A; 115/0.5 R

[51] Int. Cl.[2] ..... B63H 1/30

[58] Field of Search ..... 115/0.5 R, 28 R, 28 A, 115/29–33; 114/67 R, 0.5 R, 56; 9/1 R; 180/7 R

[56] References Cited

UNITED STATES PATENTS

| | | | |
|---|---|---|---|
| 3,154,043 | 10/1964 | Momsen, Jr. | 114/67 R |
| 3,221,702 | 12/1965 | Clark | 115/28 A |
| 3,623,566 | 11/1971 | Orloff | 115/28 A |

FOREIGN PATENTS OR APPLICATIONS

| | | | |
|---|---|---|---|
| 2,076,778 | 9/1971 | France | 115/0.5 R |

*Primary Examiner*—Trygve M. Blix
*Assistant Examiner*—Sherman D. Basinger
*Attorney, Agent, or Firm*—Haseltine, Lake & Waters

[57] ABSTRACT

A vehicle adapted to be advanced in a fluid by deforming itself progressively along its length, the vehicle comprising a head containing a fluid compressor and a body connected to the head and having a flexible and deformable envelope. An assembly of longitudinally displaceable rings is mounted in the body and the rings are connected to longitudinal and toroidal muscle elements for applying radial and longitudinal forces to the envelope at spaced locations along the length thereof to form a continuously generated progressive wave along the envelope which serves to propel the vehicle in the fluid.

12 Claims, 11 Drawing Figures

VEHICLE ADAPTED TO BE ADVANCED IN A FLUID

FIELD OF THE INVENTION

The present invention relates to autopropulsers of variable shapes and particularly to autopropulsers whose shape changes in the form of a progressive wave. Such autopropulsers will be considered hereafter to be of progressive wave type which is adapted to constitute aquatic or subaquatic vehicles. The autopropulser is in the form of a fish. In general manner, the autopropulsers of the invention constitute artificial fish which can transport loads.

BACKGROUND

The autopropulsers of the invention are inspired in movement by aquatic animals which have been studied from the cinematic and energetic point of view by Lighthill in the article "Aquatic Animal Propulsion of High Hydrodynamic Efficiency" Journal of Fluid Mechanics, 1970, Vol. 44, part 2, pages 265–301. According to this article, the movement of aquatic animals which assure their proper propulsion are classified in two types:

a. movement of the caudal fin which is a movement at the stern of a flexible wall in contact with water on its two faces and travelled over by a progressive wave towards the rear;

b. undulation in the form of a progressive wave of the skin of the aquatic animal. This is a movement of the same type as that preceding but one face only of the flexible wall is in contact with the water.

The autopropulser of the invention is related to the second type. It comprises essentially a flexible and elastic envelope of generally streamlined form endowed with flexural elasticity and means for applying movement to different points of this envelope of the same nature and out of phase with respect to one another such that the tangent of the envelope at each point conforms to the tangent to the profile of a transverse progressive wave in the water. The surface of the flexible envelope thus conforms itself to the surface of the progressive wave in the water.

In order to effect the desired movement of the envelope, the invention utilizes artificial muscles as described in French patent 2,076,778 of January, 1970 in the name of the present Applicant. One such artificial muscle is constituted by an envelope having a flexible and elastic wall in the form of a cylinder or more generally of an elongated surface of revolution and by two non-extensible filametry networks situated on said surface. The two filamentary networks can be attached to one another or not at their crossing points and they have the form of helixes or of pseudo-helixes of opposite direction wound on said elongated surface of revolution, the assembly forming a deformable trellis around this surface.

If the angle of the tangent to the helixes with respect to the axis of the cylinder or more generally the angle of the tangents to the pseudo-helixes or loxodromies with the generatrix of the surface of revolution is less than a certain critical value, increase in the volume of the envelope due to a pressure increase causes a shortening of its length and the enevelope functions as an ordinary muscle such as a biceps.

The preceding patent also describes a toroidal muscle constituted in analogous fashion to the muscle described hereinabove, that is to say, it shortens itself in length by expanding under the effect of the pressure; also contemplated is a toroidal muscle constituted in analogous manner but functioning in opposite sense, that is to say, it is elongated in length while becoming narrower under the effect of the pressure.

SUMMARY OF THE INVENTION

According to the invention, there is provided a vehicle which is displaced in a fluid, for example, an aquatic vehicle in the form of a fish whose body is formed by a flexible envelope and which comprises means for application at points of this flexible envelope of components of movements such that the envelope is impelled in the form of a progressive propulsion wave in the fluid.

The components of movements are applied to the envelope by means of artificial muscles of the structure which has been described above.

As will be shown hereafter, the progressive wave has, in the general case, a transverse component with respect to the direction of movement and longitudinal component with respect to this direction. There is thus contemplated the application at the suitable points of the flexible envelope of orthogonal components of movement.

BRIEF DESCRIPTION OF THE DRAWING

The invention will next be described in detail with reference to the annexed drawings, in which.

DETAILED DESCRIPTION

Figure 1:
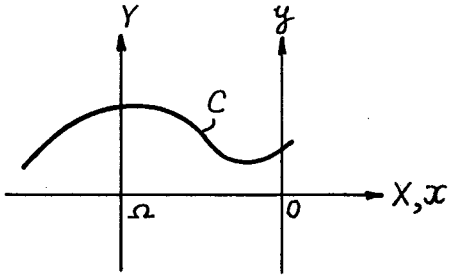
FIG. 1 is a graphical representation of a progressive wave permitting establishment of the equations of movement of the envelope.

We will next consider in a vertical plane (FIG. 1) an orthogonal system of axes O$xy$ fixed with respect to an incompressible fluid and another orthogonal system of axes XY, in which X is movable with respect to O$x$ connected to a vehicle travelling in this fluid. It is assumed that the vehicle is displaced with a speed $v$ parallel to O$x$ and that the vehicle carries a flexible deformable blade whose trajectory in the plane XY is a curve C whose parametric equations are:

$$X = f(\theta,t) \qquad Y = (\theta,t) \tag{1}$$

where $\theta$ is the parameter of the point on the curve and $t$ represents time. It is assumed, furthermore, that as the vehicle is displaced, the movement of the blade should be slightly analogous to that of a serpentine movement such that with respect to the fixed axis system, this curve remains fixed, and that it should satisfy the equation:

$$h(x,y) = 0 \tag{2}$$

The point M whose coordinates are X,Y with respect to the vehicle, will have coordinates $x,y$ with respect to the fixed axis such that:

$$\begin{aligned} x &= vt + f(\theta,t) \\ y &= g(\theta,t) \end{aligned} \tag{3}$$

wherein:

$$h(x,y) = h\,[vt + f(\theta,t),\, g(\theta,t)] = H\,(\theta,t) = 0 \tag{4}$$

There is found a differential independent relation for $h$ by writing:

$$\begin{aligned} \frac{\delta H}{\delta t} &= \frac{\delta h}{\delta x}(vt + f(\theta,t),g(\theta,t)\quad v + \frac{\delta f}{\delta t} + \frac{\delta h}{\delta y}(vt + f(\theta,t),g(\theta,t)\quad \frac{\delta g}{\delta t} = 0 \\ \frac{\delta H}{\delta t} &= \frac{\delta h}{\delta x}(vt + f(\theta,t),g(\theta,t)\quad \frac{\delta f}{\delta \theta} + \frac{\delta h}{\delta y}[vt + f(\theta,t),g(\theta,t)]\quad \frac{\delta g}{\delta t} = 0 \end{aligned} \tag{5}$$

The elimination of the two partial derivatives $\delta h/\delta x$, $\delta h/\delta y$ gives the relation in which are satisfied $f$, $g$ and $v$:

$$\frac{v + \dfrac{\delta f}{\delta t}}{\dfrac{\delta f}{\delta \theta}} = \frac{\dfrac{\delta g}{\delta t}}{\dfrac{\delta g}{\delta \theta}} \tag{6}$$

This linear equation of the partial derivatives gives the form of the wave $h(x,y) = 0$ of the progressive wave and one of the functions $f$ or $g$ for determining the other.

This equation is going to be verified in the two practical cases where the wave form of the progressive wave is sinusoidal or cycloidal.

I First case — sinusoidal wave
In this case:

$$h(x,y) = y - A \sin \frac{2\pi x}{\lambda} = 0$$

where A and $\lambda$ are constants.

I, 1 — The simplest case is that where the curve described by the edge of the vehicle does not depend on time. In this case $$\begin{aligned} x &= \theta \\ f\,(\theta,\, t) &= \theta - vt \\ g\,(\theta,\, t) &= A \sin \frac{2\pi\theta}{\lambda} \quad \text{(independent of } t\text{)} \end{aligned}$$

There is obtained:

$$v + \frac{\delta f}{\delta t} = \frac{\delta g}{\delta t} = 0$$

and equation 6 is verified.

I, 2 — The more complicated case is that where the curve described by the edge of the vehicle is a function of time:

$$\begin{aligned} X &= \phi\,(\theta,t) \\ f\,(\theta,t) &= \phi\,(\theta,t) - vt \\ g\,(\theta,t) &= A \sin \frac{2\pi\phi\,(\theta,t)}{\lambda} \end{aligned}$$

$$\frac{\delta f}{\delta t} = \frac{\delta \phi}{\delta t} - v \quad \frac{\delta f}{\delta \theta} = \frac{\delta \phi}{\delta \theta}$$

$$\frac{\delta g}{\delta t} = \frac{2\pi A}{\lambda}\,\frac{\delta \phi}{\delta t} \cos \frac{2\pi\phi(\theta,t)}{\lambda}$$

$$\frac{\delta g}{\delta \theta} = \frac{2\pi A}{\lambda}\,\frac{\delta \phi}{\delta \theta} \cos \frac{2\pi\phi(\theta,t)}{\lambda}$$

Equation 6 is thus verified, each member being equal to $$\frac{\delta \phi}{\delta t} \Big/ \frac{\delta \phi}{\delta \theta}$$

II. Second Case, cycloidal wave.
In this case $$\begin{aligned} x &= R\theta - r \sin\theta \\ y &= R - r \cos \theta \end{aligned}$$

$R$ and $r$ are two constants. If $R=r$, the curve is cycloid and if $r < R$ the curve is an elongated cycloid.

II, 1 — The most simple case is that where the curve described by the edge of the vehicle does not depend on time. In this case:

$$\begin{aligned} f(\theta,t) &= R\theta - r \sin \theta - vt \\ g\,(\theta,\, t) &= R - r \cos \theta \quad \text{(independent of } t\text{)} \end{aligned}$$

There is obtained $$v + \frac{\delta f}{\delta t} = \frac{\delta g}{\delta t} = 0$$

II, 2 — The more complicated case is that where the curve described by the edge of the vehicle is a function of time:

$$\begin{aligned} f(\theta,t) &= R\phi\,(\theta,t) - r \sin \phi\,(\theta,t) - vt \\ g(\theta,t) &= R - r \cos \phi\,(\theta,t) \end{aligned}$$

$$\frac{\delta f}{\delta t} = [R - r \cos \phi\,(\theta,\, t)]\,\frac{\delta \phi}{\delta t} - v$$

$$\frac{\delta f}{\delta \theta} = [R - r \cos \phi\,(\theta,\, t)]\,\frac{\delta \phi}{\delta \theta}$$

$$\frac{\delta g}{\delta t} = r \sin\phi\,(\theta,\, t)\,\frac{\delta \phi}{\delta t}$$

$$\frac{\delta g}{\delta \theta} = r \sin\phi\,(\theta,\, t)\,\frac{\delta \phi}{\delta \theta}$$

The equation is verified, each member being equal to $$\frac{\delta \phi}{\delta t} \Big/ \frac{\delta \phi}{\delta \theta}.$$

Figure 11:
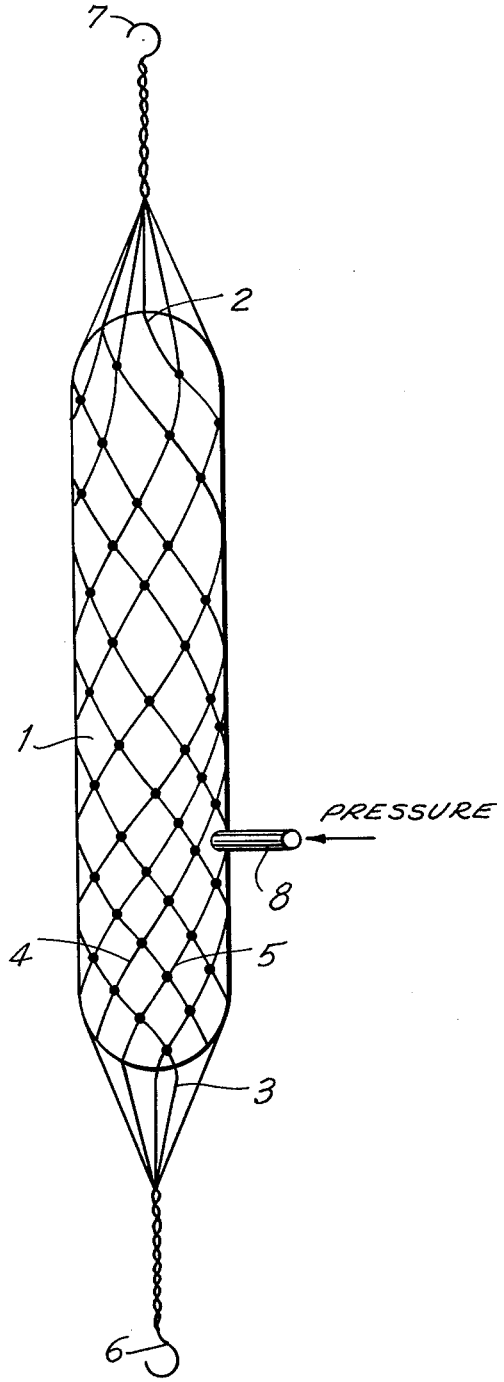
FIG. 11 PRIOR ART
FIG. 11 shows an artificial muscle of conventional type as utilized in the invention.

FIG. 11 illustrates an artificial muscle which is adapted for modifying the shape of the envelope of the vehicle to conform to the desired wave shape. The elastic envelope of the muscle is a right cylinder 1 having a circular cross-section and rounded terminal ends 2 and 3. The cylinder is enveloped by a trellis formed of two sets 4 and 5 of non-extensible filaments, the first set being constituted by helixes wound at a certain angle and in a certain direction of rotation and the second set by helixes at the same angle and of opposite direction of rotation. At their points of intersection, the filaments 4 and 5 are secured. At the extremities of the cylinder 1, the filaments are joined together and fixed to two hooks 6 and 7. The envelope is provided with a valve 8 connected to a source of pressure (not shown). If the angle of the helixes with respect to the axis of the muscle is large, pressurization produces an elongation of the muscle. If it is small, the pressurization produces a shortening of the muscle.

In the region where the flexible envelope of the muscle is of cylindrical form, it can be given a toroidal form. There is thus obtained a toroidal muscle whose outside diameter increases or decreases when it is put under pressure.

Figure 2:
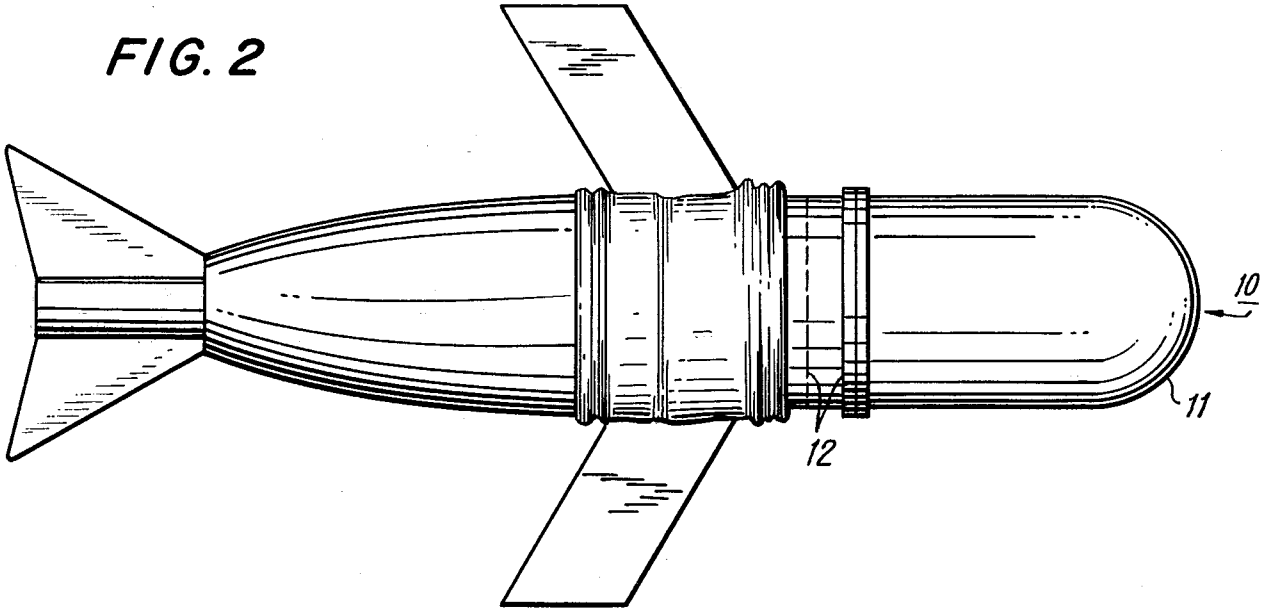
FIG. 2 is a diagrammatic plan view of a vehicle according to the invention.
Figure 3:
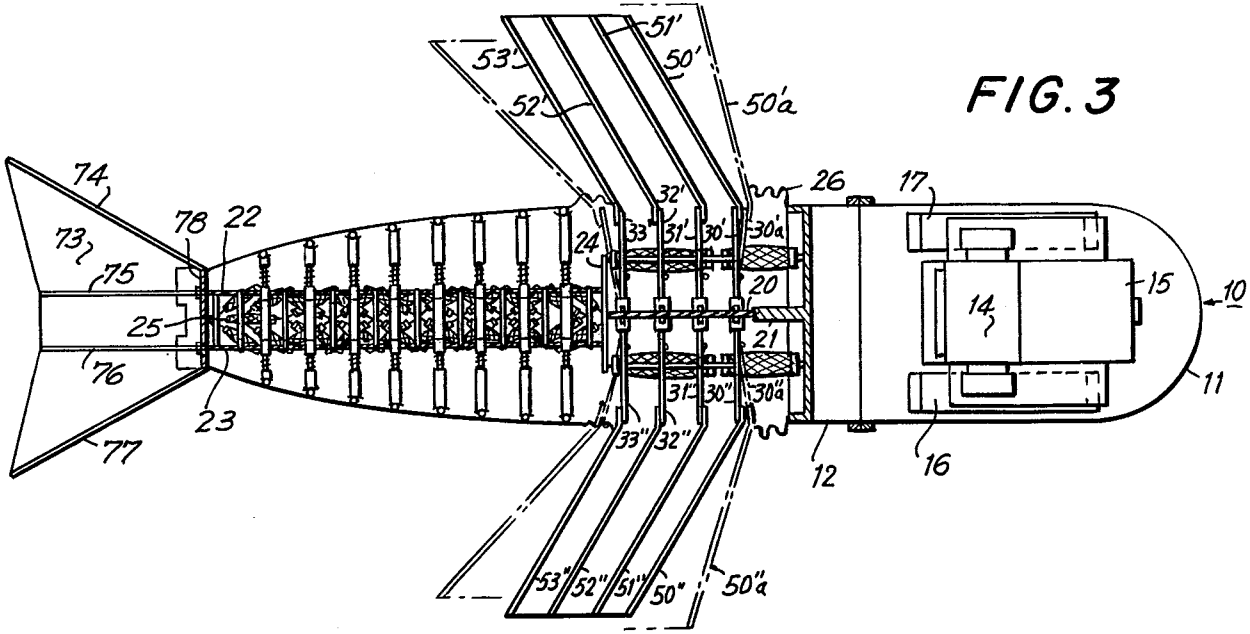
FIG. 3 is a sectional plan view taken through the longitudinal axis of the vehicle.
Figure 4:
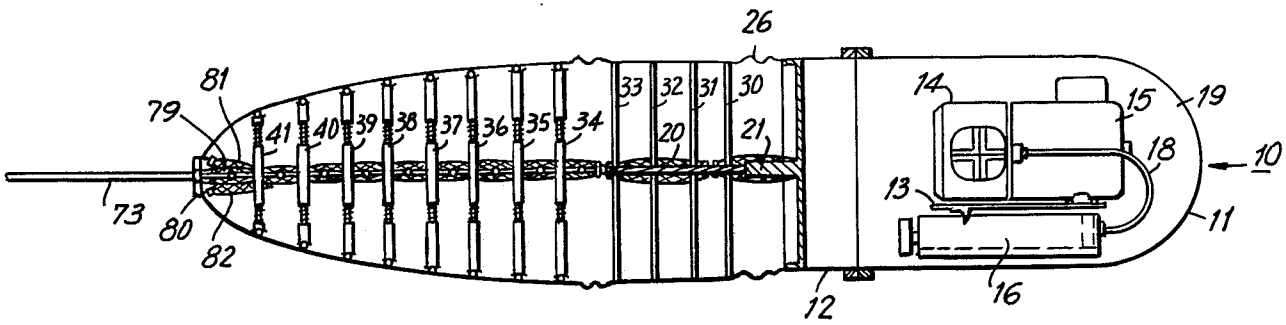
FIG. 4 is a sectional elevation view taken through the longitudinal axis of the vehicle.

Referring to FIGS. 2, 3 and 4, therein is shown an artificial fish according to the invention, this fish comprising a head constituted by a cylindrical envelope 10 of stainless steel closed at the front by a rounded cover 11 and at the rear by a fixed cover 12 forming part of the body. A transverse matallic plate 13 supports, at the top, a compressor 14 and an electric drive motor 15, and at the bottom, two compressed air reservoirs 16 and 17 which communicate with one another. The compressor communicates with the reservoirs by conduits 18. When the cover is in place, it assures the sealing of the interior of the head, this interior constituting a low pressure chamber 19. The compressor 14 compresses this air in the two reservoirs 16 and 17 which constitute the pressure chamber.

The body is formed as a body of revolution around its longitudinal axis. It comprises cover 12 to which there is fixed at its center a large twisted steel cable 20 through the intermediary of a rigid longeron 21. The cable 20 has a certain flexibility. It is extended at the rear by two twisted cables 22 and 23 which are parallel to the main cable 20 but are smaller therethan. Therefore, cables 22 and 23 are more flexible. Cables 22 and 23 are laterally secured to one another and to the main cable by means of a system of bolted cross-braces 24 and 25. Fixed to the cable 20 or the longeron 21 are a number of rings 32, 33 and slidably mounted on the cables 22 and 23 are a number of further rings 34 to 41. These fixed and slidable rings are regularly spaced longitudinally. The rings 30–33 comprise a central collar in which passes the cable 20 or the longeron 21, and rings 34–41 include two collars which are symmetrical with respect to the center of the rings in which the cables 22 and 23 pass such that the rings at rest are always perpendicular to the cables.

The body of the fish is formed by a flexible and sealed envelope 26, for example, of synthetic rubber. This envelope has a certain slack to be able to follow the internal movements of the cables and the rings. The envelope 26 is fixed to the cover 12, to the circumference of the rings 34 to 41, as well as additionally to the circumference of the fins which will be described hereafter.

Figure 5:
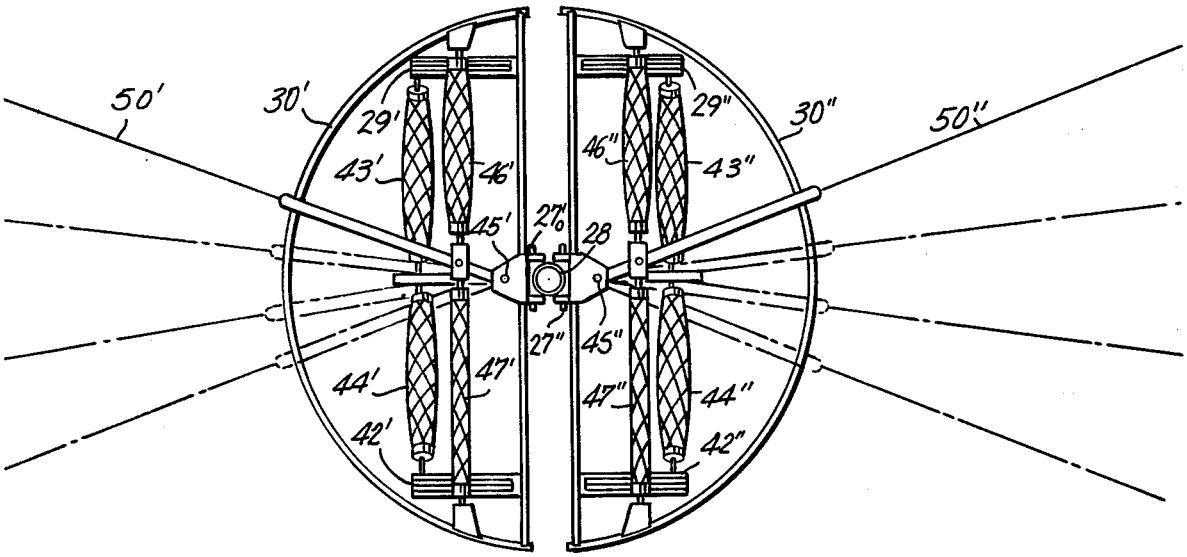
FIG. 5 is a transverse sectional view on enlarged scale of the pectoral fin and its control system.
Figure 6:
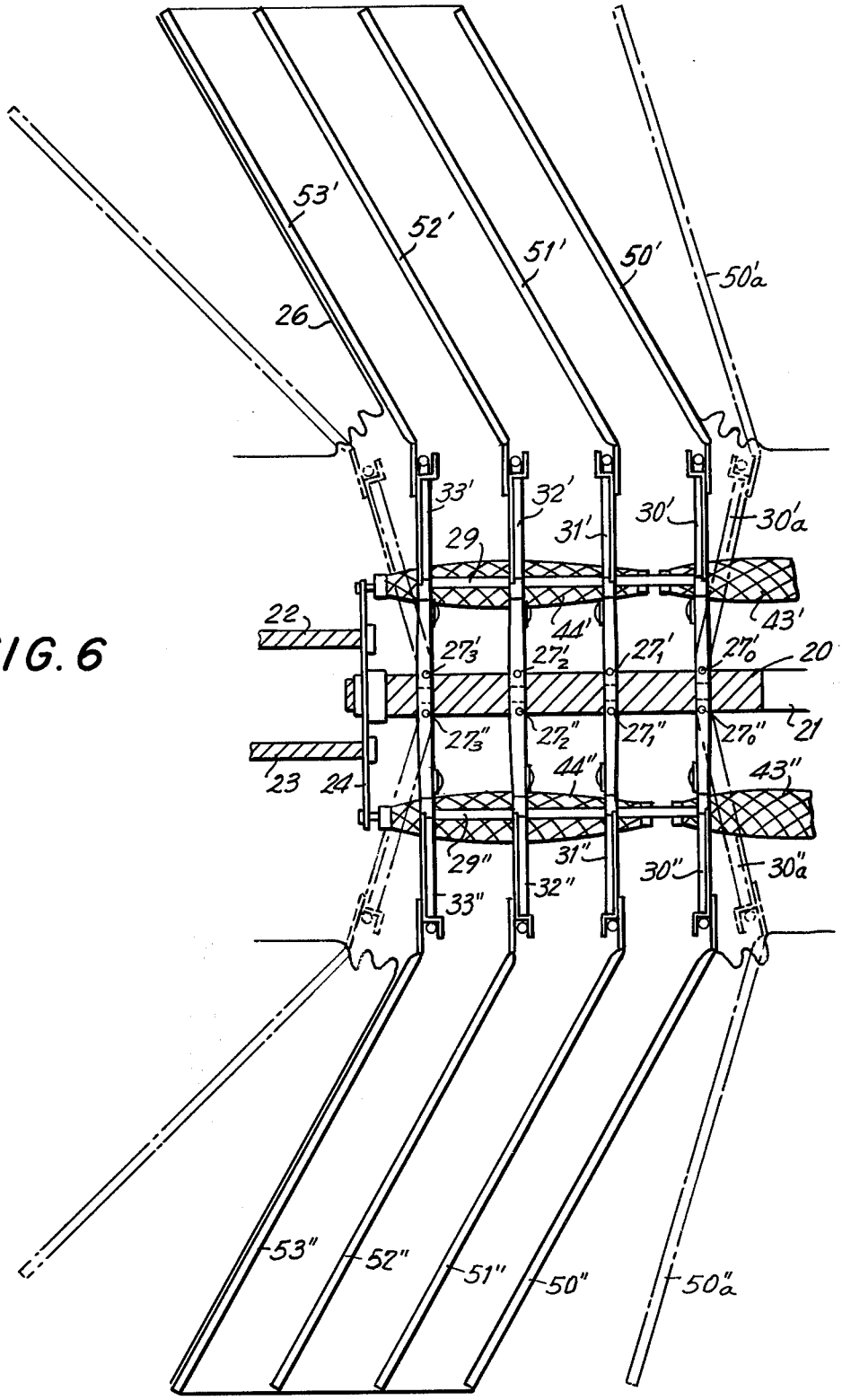
FIG. 6 is a longitudinal section on enlarged scale of the pectoral fin and its control system.

II—Pectoral Fins (FIGS. 5 and 6)

The artificial fish comprises two pectoral fins respectively comprising four ribs 50′ to 53′ and 50″ to 53″. The ribs of the pectoral fins 50′ to 53′ and 50″ to 53″ are associated with rings 30 to 33. These four rings respectively comprise two half rings 30′, 30″ to 33′, 33″ which are each articulated around a vertical axle 27. These axles 27 are fixed to central collar 28 mounted by screws on the rigid longeron 21 or on the cable 20. The half rings can thus pivot towards the front or towards the rear while displacing the associate rib of the pectoral fin. These ribs are inclined towards the rear in a manner to be able to be retracted lengthwise of the body of the artificial fish when the half-rings are inclined to the maximum towards the rear. The half-rings are controlled by muscles and are respectively displaced in parallel planes. Thus the half-rings 30′ and 30″ can take the positions 30′ and 30″ shown in dotted lines in FIG. 6.

In FIG. 6, the half-rings 30′-30″ to 33′-33″ are articulated around the vertical axles $27_0'$–$27_0''$ to $27'_3$–$27_3''$. These half-rings are all connected together by cross pieces 29′ and 42′ and 29″ and 42″. Two pairs of muscles 43′, 43″, 44′, 44″ are secured to fixed pieces on one side and to the cross pieces 29′ and 29″ and 42′ and 42″ on the other side. The four half-rings 30′ to 33′ are controlled by the muscles 43′ and 44′ (FIG. 5). The muscles 43′ and 44′ and 43″ and 44″ operated in opposite phase from one another. If the muscle 43′ is shortened and the muscle 44′ elongated, the four half-rings 30′–33′ are displaced towards the front. The half-ring 30′ comes to the position $30_a'$ and the three other half-rings take positions parallel thereto. The rib 50′ comes to position $50_a'$ and the three other rings take positions parallel thereto. If the muscle 43′ is elongated and the muscle 44′ shortened, the movement of the ribs 50′-53′ is effected towards the rear.

Any one rib, such as 50′ for example, comprises an interior portion which remains in the plane of the corresponding half-ring 30′ but in addition it can turn around an axle 45′ fixed on the half-ring 30′. This movement is controlled by a pair of muscles 46′-47′ one of which is elongated while the other is shortened. The portion of the rib 50′ external to the half-ring 30′ is oblique with respect to the plane of this half-ring. This disposition is clearly shown in FIG. 6.

These considerations are applicable for all ribs 50′ to 53′ and 50″ to 53″. The four left ribs 50′ to 53′ and the right ribs 50″ to 53″ serve as braces for a blade of thin rubber which is flexible, solid and sufficiently loose to permit the preceding movements. This blade forms part of the general envelope 26.

Figure 7:
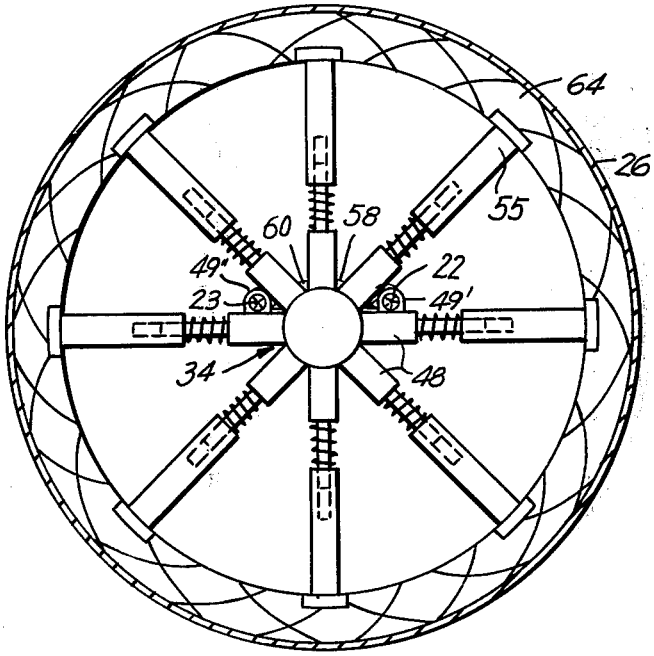
FIG. 7 is a transverse sectional view through the body and caudal fin showing the control system of the caudal fin and the system of application to the envelope of the body of the progressive wave for propulsion.
Figure 8:
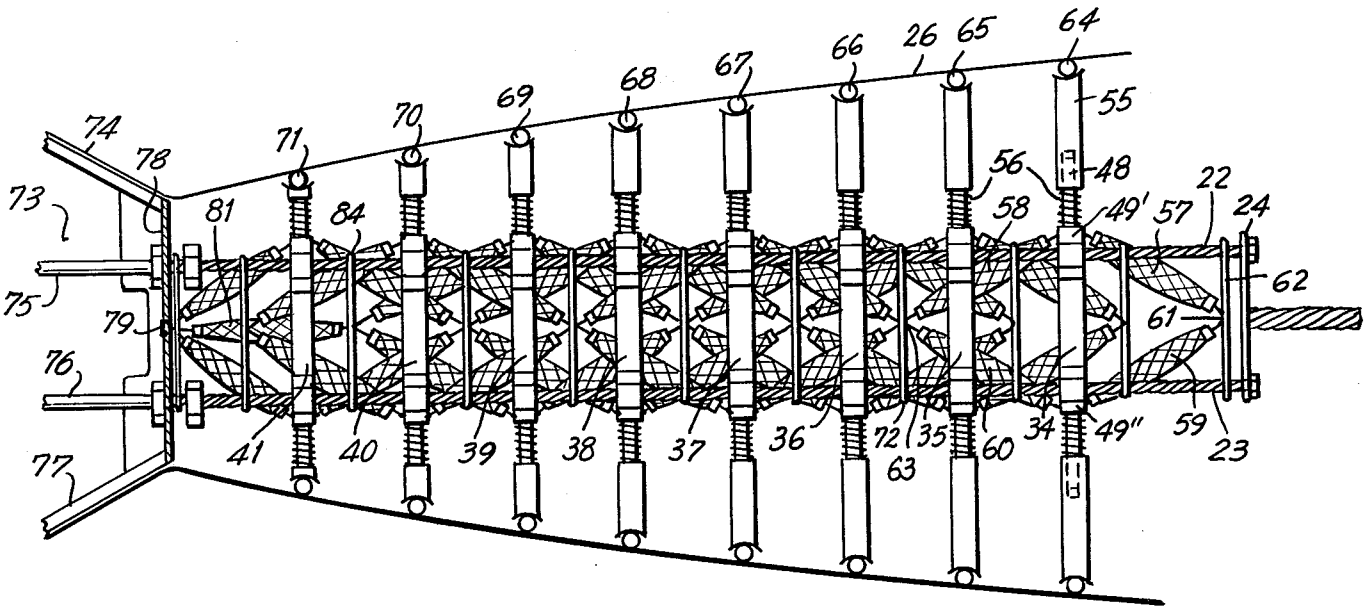
FIG. 8 is a longitudinal sectional view showing the structure of FIG. 7.

III — Body of the Fish (FIGS. 7 and 8)

The rings 34 to 41 each comprises a plurality of spokes 48 and two spokes 48 are aligned and carry two sockets or collars 48′ and 49″ in which cables 22 and 23 pass. The collars are not secured to the cables and as a result the rings 34 to 41 can slide on the cables.

The spokes 48 of the rings carry at their extremities seats 55 in the form of sleeves which slide on the spokes and are urged outwardly by springs 56. These seats 55 support toroidal muscles 64 to 71 whose diameter increases when they are put under pressure. These torsidal muscles are welded or otherwise attached to the flexible envelope 26 of the fish along their peripheries. As a result of this disposition, when the toroidal muscle is put under pressure, the diameter of the body of the fish increases in the plane of the muscle, and when the pressure is terminated, the diameter decreases.

The longitudinal position of each ring 34 to 41 is controlled by rectilinear muscles 57, 58, 59, 60. Two muscles 57–58 are attached to the collars 49' and two muscles 59, 60 are attached to a hook 61 carried by a bar 62 joining cables 22 and 23 and the two muscles 58 and 60 are attached to a hook 63 carried by a bar 72 also joining the cables 22 and 23.

In order not to give the rectilinear muscles 57–60 too great an inclination in the longitudinal direction of the body of the fish, each pair of muscles controlled in one direction of translation of one of rings 34–41, passes through one or a plurality of other rings. In order that the spokes of a ring should not be an obstacle to the passage therethrough of the control muscles or translation of another ring, the spokes of the different rings are angularly offset from one ring to the next. As a result of this disposition, when one or another of two groups of rectilinear muscles is put under pressure, the longitudinal position of the ring controlled by these muscles is modified. The control of a toroidal muscle 64 for example, and the simultaneous control in opposite phase of two groups of rectilinear muscles 57–59 and 58–60, for example, apply two orthogonal components of movement to the points on the flexible envelope of the fish coincident with the exterior equator of the toroidal muscle.

IV — Caudal Fin (FIGS. 3 and 8)

The caudal fin comprises a flexible blade 73 having four flexible ribs 74–77 secured to a rigid plate 78. This plate comprises two levers 79 and 80 (FIG. 4) extending perpendicular to the plate. To these levers are attached two rectilinear muscles 81 and 82 whose other extremities are attached to a hook 83 carried by a bar 84 itself attached to the cables 22 and 23.

Figure 9:
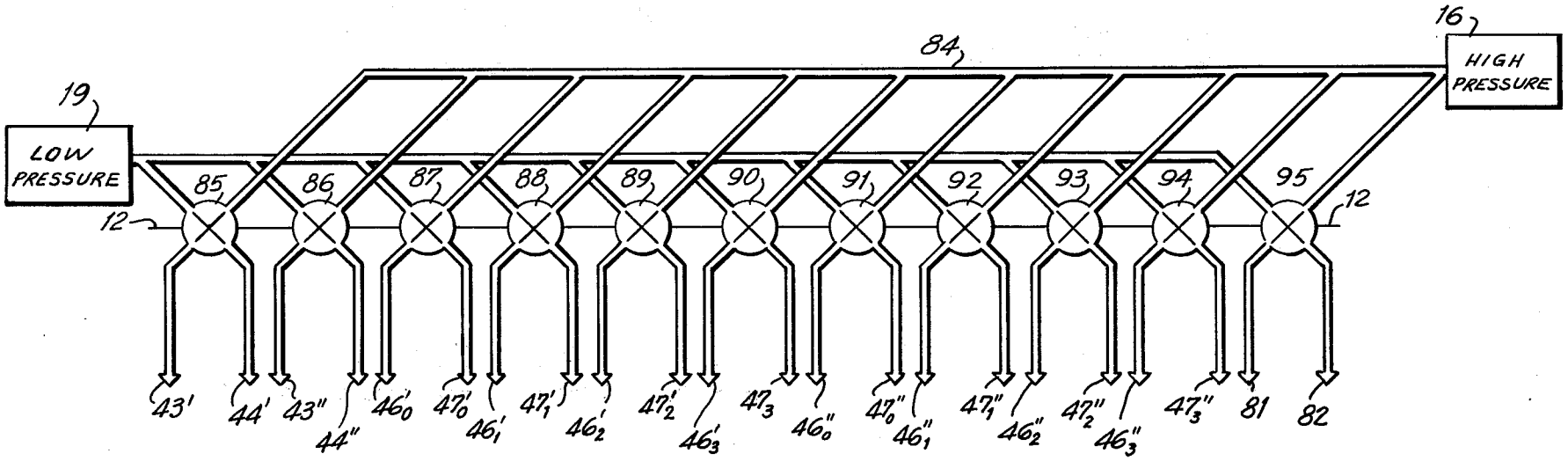
FIG. 9 is a schematic diagram which shows a system of feed valves for the muscles of on-off type.
Figure 10:
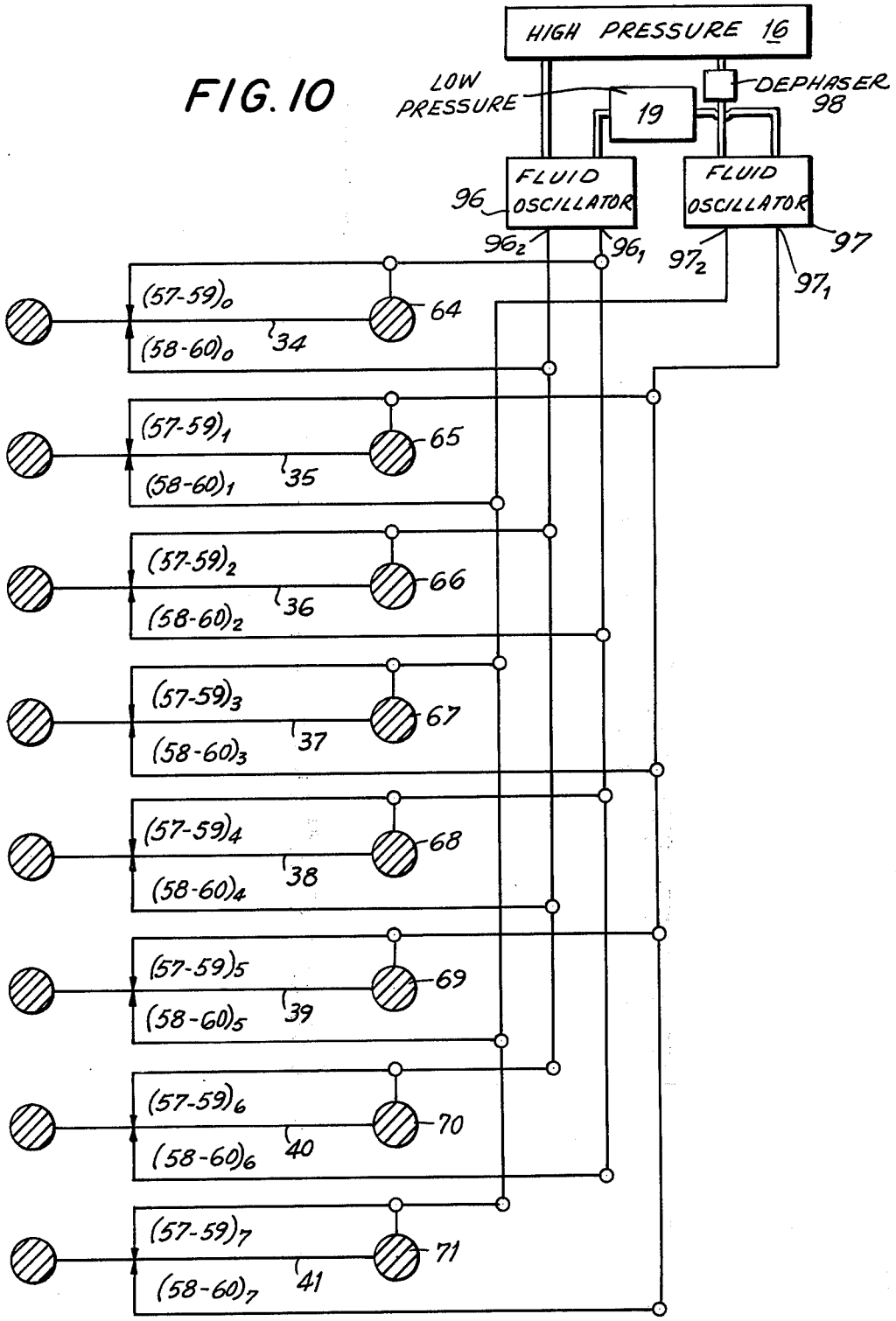
FIG. 10 is a schematic diagram which shows the fluid control system for the different muscles by signals as a function of time.

V — Control of the Muscles (FIGS. 9 and 10)

It is seen that the pectoral fins are controlled by the rectilinear muscles 43'-44', 43''-44'' and the rectilinear muscles such as 46'-47', 46''-47'' (there are as many groups of four muscles as there are ribs of the pectoral fins or sixteen muscles in the case of the four ribs 30–33), the movement of the skin of the body of the fish by the toroidal muscles 64–71 and the rectilinear muscles such as 57, 58, 59, 60 (there are as many groups of four muscles as there are rings 34–41 or thirty-two muscles) and the caudal fin by the pair of recilinear muscles 81–82.

Three-way valves or four-way valves are placed in the cover 12. The three-way valves each comprises a first inlet connected to one of the high-pressure chambers 16 and 17 by tubes 84, a second inlet opening into the low pressure chamber 19 and an outlet connected to one or a plurality of artificial muscles. The four-way valves comprise the same two inlets as the three-way valves and two outlets connected to one or a plurality of artificial muscles when these muscles are grouped in pairs working in opposite phase.

The muscles 43'–44' are connected to the outlets of four-way valve 85 and the muscles 43''-44'' are connected to the outlets of four way valve 86. The muscles 46'-47' for individual control of the four ribs of one pectoral fin are respectively connected to the outlets of the four-way valves 87, 88, 89, 90 and the muscles 46''-47'' for individual control of the four ribs of the other pectoral fin are respectively connected to the outputs of the four-way valves 91, 92, 93, 94. The muscles 81–82 for control of the caudal fin are respectively connected to the outputs of the four way valve 95.

The movements of the skin of the fish produced by the toroidal muscles for radial control and the rectilinear muscles for longitudinal control are obtained by means of a fluid oscillator and fluid dephasers. Fluid oscillators are known in the art. A fluid oscillator producing a triangular saw tooth wave is described for example in the work "Fluid Control Components and Systems" by S. Y. Lee, published by the Technidivision Services, Maidenhead, England, pages 74–75. This oscillator has two outputs in phase opposition. Two such oscillators 96 and 97 are fed by high pressure air, the first directly, the second through a dephaser 98 of one quarter of a period of the frequency of oscillation of the oscillators. The output $\mathbf{96}_1$ of the oscillator 96 is connected to the muscles $(\mathbf{57–59})_0$ and 64, $(\mathbf{57–59})_4$ and 68, $(\mathbf{58–60})_2$, $(\mathbf{58–60})_6$. The output $\mathbf{96}_2$ of the oscillator 96 is connected to the muscles $(\mathbf{58–60})_0$, $(\mathbf{58–60})_4$, $(\mathbf{57–59})_2$ and 66, $(\mathbf{57–59})_6$ and 70. The output $\mathbf{97}_1$ of the oscillator 97 is connected to the muscles $(\mathbf{57–59})_1$ and 65, $(\mathbf{57–59})_5$ and 69, $(\mathbf{58–60})_3$, $(\mathbf{58–60})_7$. The outlet $\mathbf{97}_2$ of the oscillator 97 is connected to the muscles $(\mathbf{58–60})_1$, $(\mathbf{58–60})_5$, $(\mathbf{57–59})_3$ and 67, $(\mathbf{57–59})_7$ and 71.

It is to be understood in the given embodiment that the points where the orthogonal components of movement are applied to the envelope form eight circular zones each receiving a radial movement by a toroidal muscle and a longitudinal movement by a group of rectilinear muscles and that these zones correspond to two lengths of a wave of the progressive wave of propulsion and that the movements should be applied with a dephasing from one zone to the other of one quarter of a period; it should also be understood that the progressive wave of propulsion can be obtained by acting on the envelope in the zones having one spatial determined dephasing by movements having the same dephasing in time.

Finally, it should be understood that although the given embodiment is drawn to an aquatic vehicle, it is possible to form in the same manner aerial vehicles in which the gas contained in the envelope is a gas much lighter than air.

What is claimed is:

1. A vehicle adapted to be advanced in a fluid by deforming itself progressively along its length, said vehicle comprising a head including means for compressing a fluid, a body connected to said head and including a flexible and deformable envelope, and means coupled to said fluid compressing means for applying radial and longitudinal forces to said body at spaced locations along the length thereof to form a continuously generated progressive wave along said envelope which serves to propel the vehicle in the fluid, said means for applying the forces including toroidal muscle elements coupled to said envelope and selectively fed with compressed fluid for producing radial forces to deform the envelope radially at said locations and longitudinal muscle elements coupled to said envelope and selectively fed with compressed fluid for producing longitudinal forces to deform the envelope longitudinally at said locations.

2. A vehicle as claimed in claim 1 wherein said toroidal muscle elements each includes an elastic wall attached to said deformable envelope and having a variable diameter as a function of the pressure of said fluid.

3. A vehicle as claimed in claim 1 wherein said longitudinal muscle elements each is an elongated body of revolution with an elastic wall which has a variable length of function of the pressure of said fluid.

4. A vehicle as claimed in claim 1 wherein said means for applying the forces to said body comprises a plurality of longitudinally displaceable rings in said body, said longitudinal muscle elements being coupled to said rings to displace the same longitudinally, said toroidal muscle elements being supported by said rings and peripherally connected to said body.

5. A vehicle as claimed in claim 4 comprising a longeron secured to said head and means supporting said rings from said longeron for longitudinal displacement in said body.

6. A vehicle as claimed in claim 5 wherein said ring comprises a plurality of radial spoke elements, a central support means for said spoke elements supported for longitudinal displacement with respect to said longeron, and sleeves on said spoke elements supporting respective toroidal muscle elements.

7. A vehicle as claimed in claim 6 wherein said longitudinal muscle elements are secured at one end to the longeron and at the other end to respective spoke elements.

8. A vehicle as claimed in claim 7 wherein said means supporting the rings from said longeron comprises cable means secured to said longeron, said rings being displaceable on said cable means.

9. A vehicle as claimed in claim 1 comprising fluid control means coupled to said fluid compressing means for selectively feeding the muscle elements with compressed fluid.

10. A vehicle as claimed in claim 9 wherein said fluid control means comprises fluid oscillator means coupled to said fluid compressing means and having outputs at which the fluid pressures are out of phase with one another.

11. A vehicle as claimed in claim 1 comprising a pectoral fin attached to said body for pivotal movement both in horizontal and vertical planes, and means for pivotably moving said pectoral fin in synchronization with the formation of the progressive wave along said body.

12. A vehicle as claimed in claim 1 comprising a caudal fin attached to said body for pivotal movement about a vertical axis, and means for pivotably moving said caudal fin about said vertical axis.

* * * * *